US006691786B2

(12) United States Patent
Patel

(10) Patent No.: US 6,691,786 B2
(45) Date of Patent: Feb. 17, 2004

(54) INFLATABLE FLOW CONTROL DEVICE AND METHOD

(75) Inventor: Dinesh R. Patel, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 10/091,918

(22) Filed: Mar. 5, 2002

(65) Prior Publication Data

US 2003/0168220 A1 Sep. 11, 2003

(51) Int. Cl.[7] ..... E21B 34/10; E21B 34/16

(52) U.S. Cl. ..... 166/375; 166/320; 166/326; 166/133; 251/61.1; 251/61

(58) Field of Search ..... 166/375, 387, 166/53, 133, 320, 326; 251/340, 61, 61.1

(56) References Cited

U.S. PATENT DOCUMENTS 2,922,478 A * 1/1960 Maly ..... 166/154
3,490,732 A * 1/1970 Leroy ..... 251/5
3,494,588 A * 2/1970 Kisling, III ..... 251/5
3,640,354 A * 2/1972 Rassieur ..... 175/243
3,847,214 A * 11/1974 Cushman ..... 166/319
4,494,345 A * 1/1985 Peterson ..... 137/414
4,787,408 A * 11/1988 Twerdochlib ..... 137/14
4,870,859 A * 10/1989 Twerdochlib ..... 73/203
4,969,513 A * 11/1990 Barrus et al. ..... 166/53
5,205,325 A * 4/1993 Piper ..... 137/844
5,240,031 A * 8/1993 Vigil ..... 137/315.01
5,277,397 A * 1/1994 Tartaglino ..... 251/61
5,316,081 A 5/1994 Baski et al.
5,778,982 A 7/1998 Hauck et al.
5,836,353 A * 11/1998 Van Steenwyk ..... 137/624.15
5,906,238 A 5/1999 Carmody et al.
6,012,518 A 1/2000 Pringle et al.
6,053,191 A * 4/2000 Hussey ..... 137/2
6,065,544 A * 5/2000 Holbert ..... 166/387
6,257,338 B1 7/2001 Kilgore
6,260,616 B1 7/2001 Carmody et al.
6,273,195 B1 8/2001 Hauck et al.
6,334,486 B1 1/2002 Carmody et al.
6,478,091 B1 * 11/2002 Gano ..... 166/373

* cited by examiner

*Primary Examiner*—David Bagnell
*Assistant Examiner*—T Shane Bomar
(74) *Attorney, Agent, or Firm*—Trop, Pruner & Hu P.C.; Jeffrey Griffin; Brigitte Jeffery Echols

(57) ABSTRACT

A valve has a pair of surfaces, such as those of pipes, with an inflatable bladder disposed therebetween. Controlled inflation and deflation of the bladder provides for control of flow through the valve. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 CFR 1.72(b).

28 Claims, 2 Drawing Sheets

INFLATABLE FLOW CONTROL DEVICE AND METHOD

BACKGROUND OF THE INVENTION

1. Field of Invention

The present invention relates to the field of flow control. More specifically, the invention relates to a device and method for controlling flow using an inflatable element.

2. Related Art

Oil companies are continually improving their recovery systems to produce oil and gas more efficiently and economically from sources that are continually more difficult to exploit, without significantly increasing the cost to the consumer. One area in which the industry has strived for improvement is in the area of flow control. Other industries have significant needs for improved flow control as well.

SUMMARY

In general, according to one embodiment, the present invention provides an inflatable flow control device. Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

Figure 1:
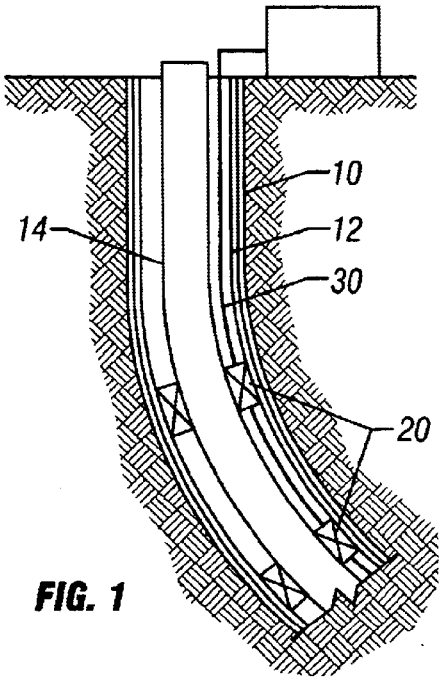
FIG. 1 illustrates a well having two devices of the present invention therein.

FIG. 1 shows a well 10 with a casing 12 and a production tubing 14 therein. The well also contains two valves 20 of the present invention that control flow within the well 10. A control line 30 extends from the surface to the valves 20. The control line 30 communicates with the valves 20 allowing remote control of the valves 20.

Figure 2:
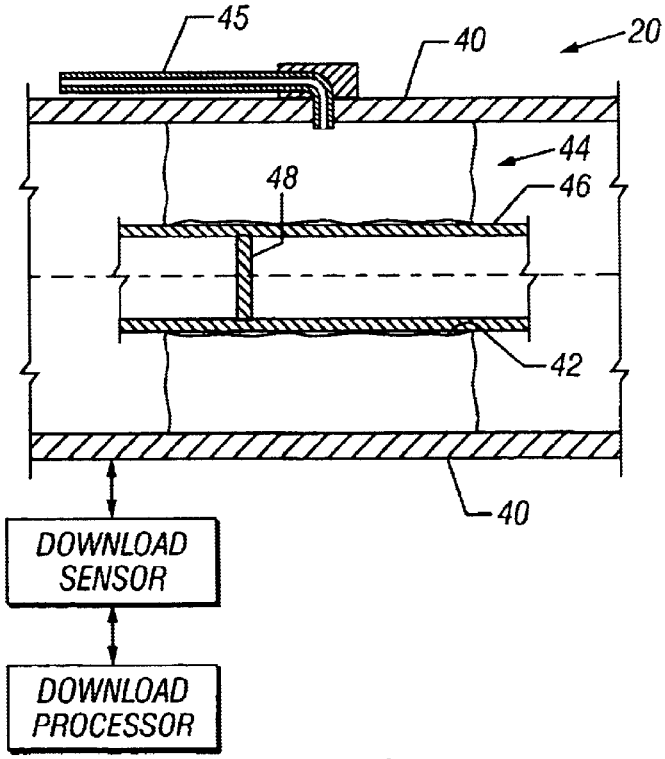

FIG. 2 discloses one embodiment of the present invention in the form of a fluid pressure actuated bladder valve. The bladder 44 of the invention is positionable in a section of pipe such that an outer diameter thereof is attached to the inner diameter of the pipe 40 and the inner orifice of the bladder 44 is open or closed depending upon the amount of pressure inside the bladder relative to ambient pressure in the vicinity of the bladder. A toroidal shaped bladder 44 is positioned in the inside of a pipe 40. The bladder 44 may be bonded to the inside of the pipe 40 (the inside surface) using an adhesive or any other suitable attachment arrangement which includes but is not limited to a mechanical attachment magnetic element inside the bladder 44 which then pinches the wall of the bladder 44 between the magnetic element and the pipe 40 in which the bladder is positioned. Alternatively, the bladder 44 may be simply positioned in the pipe 40 and maintained in the desired position by friction caused by pressure internal to the bladder 44. The bladder 44 may also be attached by other mechanical methods. The bladder 44 has an orifice 42 that allows fluid flow through pipe 40 when the bladder 44 is not inflated. The bladder 44 is preferably made of an elastic material that can be inflated and deflated repeatedly without structural degradation. Pressurization and depressurization of the bladder of the invention 44 is effected through a control line 45 that communicates with the interior of bladder 44. The control line 45 is in sealed communication with bladder 44. The control line 45 controls the pressure within the bladder 44 and can inflate or deflate the bladder 44 through hydraulic, pneumatic or other pressure sources.

Positioned within the pipe 40 and the bladder 44 is an inner pipe 46. The inner pipe 46 may be attached to the pipe 40 at one or both ends. Any attachment mechanism may be used. The inner pipe 46 in one embodiment has a plug 48 that prevents flow through the inner pipe 46. Although shown as a permanently attached plug in FIG. 2, the plug 48 may be a removeable plug, a flapper valve, or some other type of valve or plug that prevents flow through the inner pipe. Using a flapper valve or removeable plug facilitates access through the inner pipe 46 if needed, such as for re-entry, as well as opening of a flowpath through the valve 20 should the valve 20 fail.

In an alternative embodiment, the inner pipe 46 does not have a plug 48 therein. Instead, the inner pipe extends to a packer or other sealing device that prevents flow between the interior of the inner pipe 46 and the annulus between the inner pipe 46 and the outer pipe 40 in the area or zone of interest.

When inflated, the bladder 44 expands. Because expansion radially outwardly is inhibited by the pipe 40 in which the bladder 44 is located, the expansion is limited to radially inward and longitudinal. As the bladder undergoes radial inward expansion, the flow area between the pipe 40 and the inner pipe 46 decreases, restricting the flow therethrough. When fully inflated, the bladder 44 tends to close off orifice 42 (the annular flowpath between the pipe 40 and the inner pipe 46) by sealing against the outer surface of the inner pipe 46, thus sealing flow through the pipe 40. Desired flow through the pipe 40 can be achieved through applying a determined amount of fluid pressure to the bladder 44 to vary the flow area between opened and closed and provide for a variable orifice valve. Accordingly, the inflatable bladder 44, controls the flow between a first surface and a second surface of a tool or tools. Although described as creating a seal when closed, it should be noted that some flow through the valve 20 (e.g. five percent of full fully open flow) may be permissible and the term "closed" includes substantially closed in which there is some flow through the valve 20.

Figure 3:
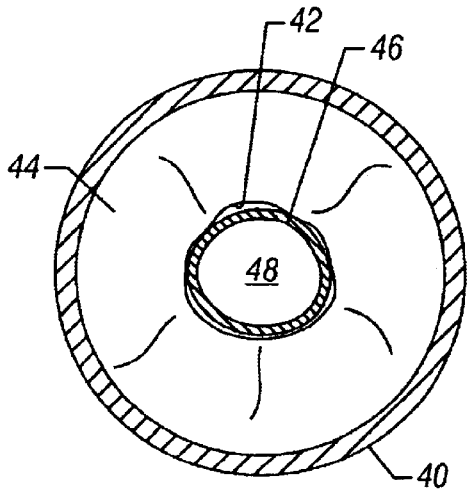
FIGS. 2 and 3 illustrate a side and end view of an embodiment of the present invention.

FIG. 3 is an end view of the pipe 40 shown in FIG. 2 including the pressure controlled valve 20 positioned inside of the pipe 40. As noted above, the centrally located orifice 42 may be opened or closed by deflating or inflating the bladder 44 to control flow through the pipe 40.

Due to the simplicity of design, the pressure controlled valve can withstand numerous cycles of opening and closing without failure. This reliability makes the pressure controlled valve ideal for applications such as downhole flow control and other applications, where ambient conditions are adverse and valve maintenance or replacement is difficult.

The pressure controlled valve may be controlled from the surface of the well or through downhole intelligence located within the well. A representative downhole intelligent control is schematically illustrated in FIG. 2 but it will be appreciated that the invention is also capable without the intelligent systems illustrated. Downhole intelligence, intelligent sensor arrangements, (e.g., position sensors, pressure sensors, temperature sensors, etc.) and communications for communicating to a downhole or surface microprocessor via any conventional communication device or media such as telemetry devices, wireline, TEC wire, cable, etc., are beneficial to the operation of the above-described valve. By monitoring conditions downhole, metered adjustments of the pressure controlled valve can be made to boost efficiency and production of any given well. This type of downhole intelligence is employable and desirable in connection with all of the embodiments disclosed herein and while only some of the embodiments contain direct reference to intelligent systems and controls it will be understood that these can be for all of the embodiments.

Figure 4:
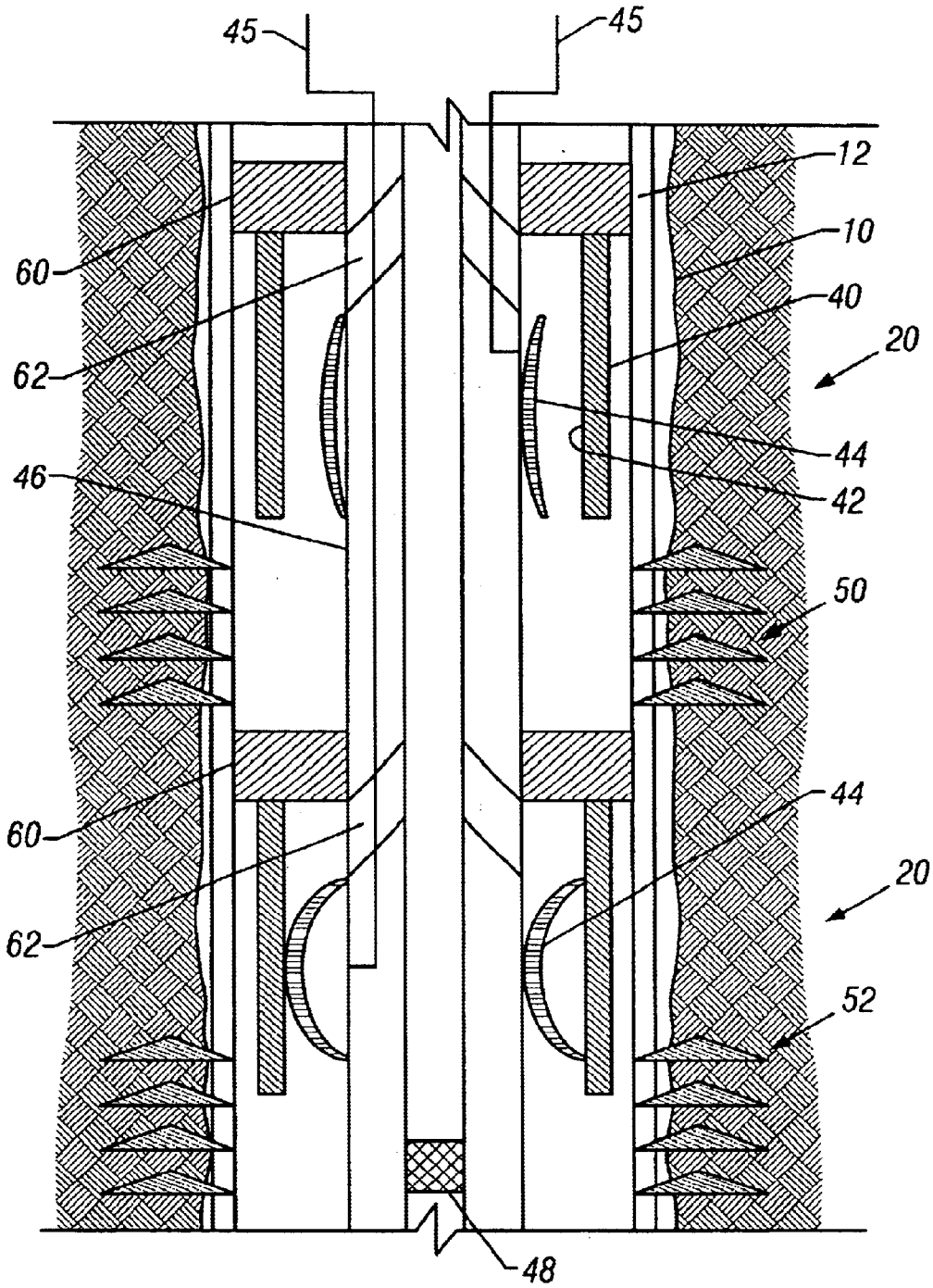
FIG. 4 illustrates another embodiment of the present invention.

FIG. 4 shows an alternative embodiment of the present invention. In the figure, the well 10 contains two valves 20, each controlling flow from a separate formation, 50 and 52. A packer 60 seals between an inner pipe 44 46 and a casing 12 in the well 10. The bladder 44 (or elements) for the valve 20 are connected to the inner pipe 46. An outer pipe 40 extends from the packer to a position radially surrounding the bladder 44. Ports 62 through the inner pipe 46 are positioned between the packer 60 and the bladder 44. Thus, the valve 20 defines a flowpath from the free end of the outer pipe 40 through the annulus between the outer pipe 40 and the inner pipe 46, past the bladder 44, through the ports 62, and into the inner pipe 46 for continued, controlled flow through the packer 60. Flow through the control line 45 controls inflation and deflation of the bladder and, thus, the variable flow through the valve 20. It should be noted that, although the figure shows two valves 20 sharing a common inner pipe 46, each of the valves 20 may have a separate inner pipe 46. Also, the figure discloses a separate control line for each valve 20, multiple valves may share one control line. In one example, multiple redundant valves may be used to control the flow from one formation (or multiple formations) and may share a common control line.

The above-described system refers to a control line provided from the surface. However, other actuating systems may be used. For example, the electro-hydraulic actuator of U.S. Pat. No. 6,012,518, which is hereby incorporated herein by reference, may be used to inflate and deflate the bladder 44 of the present invention. Other downhole actuators may be used.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

I claim:

1. A valve, comprising:

an outer pipe;

an inner pipe; and an inflatable bladder connected to the inner pipe and positioned between the inner pipe and the outer pipe to control longitudinal flow of a first fluid therebetween, the inflatable bladder comprising an interior space isolated from the first fluid to receive a second fluid to selectively expand the bladder.

2. The valve of claim 1, wherein:

the inner pipe has a plug therein.

3. The valve of claim 1, wherein:

the inner pipe and the outer pipe are connected to a packer.

4. The valve of claim 3, wherein:

the inner pipe defines a port therethrough providing communication between an interior of the inner pipe and an annulus defined by the inner pipe and the outer pipe; and the port is positioned between the packer and the bladder.

5. The valve of claim 1, further comprising:

a control line communicating with the interior space of the bladder.

6. A method for controlling flow in a well, comprising:

providing an outer pipe and an inner pipe in the well;

controlling the flow of a fluid between an annulus defined by the inner pipe and the outer pipe by selectively pressurizing an interior space of a bladder positioned between the inner pipe and the outer pipe, the controlling comprising communicating with the interior space via a control line;

isolating the interior space from the fluid; and attaching the bladder to the inner pipe.

7. A system usable with a subterranean well, comprising:

at least one valve in the well to control flow from a subterranean formation;

the at least one valve comprising an inflatable bladder provided between a pair of substantially concentrically-disposed pipes; and at least one control line in communication with an interior of the inflatable bladder.

8. The system of claim 7, further comprising:

a plurality of valves to control flow from a zone.

9. The system of claim 7, wherein the at least one valve controls flow from a plurality of formations.

10. The system of claim 9, wherein one of the at least one valves is associated with one of the plurality of formations.

11. The system of claim 7, wherein the at least one control line controls a plurality of valves.

12. The system of claim 7, wherein the interior is isolated from fluid controlled by the valve.

13. A valve for use in a well, comprising:

a valve body defining an interior surface and an outer surface; and an inflatable bladder connected to the interior surface and positioned between the interior surface and the outer surface to control flow of a first fluid therebetween, the inflatable bladder comprising an interior space isolated from the first fluid to receive a second fluid to selectively expand the bladder.

14. The valve of claim 13, further comprising:

means for controlling the expansion and contraction of the inflatable bladder.

15. A valve for use in a well, comprising:

an interior tool surface and an exterior tool surface positioned in the well;

means connected to the interior tool surface for expanding in response to a first fluid to fill the area between the interior tool surface and the exterior tool surface to control flow of a second fluid therebetween, the first fluid being isolated from the second fluid.

16. The valve of claim 15, further comprising:

means for directing the flow between the interior tool surface and the exterior tool surface.

17. A valve, comprising:

an outer pipe;

an inner pipe having a plug therein; and an inflatable bladder positioned between the inner pipe and the outer pipe capable of controlling longitudinal flow therebetween, wherein the inner pipe and the outer pipe are connected to a packer, the inner pipe defines a port therethrough providing communication between an interior of the inner pipe and an annulus defined by the inner pipe and the outer pipe and the port is positioned between the packer and the bladder.

18. The valve of claim 17, wherein:

the bladder is connected to the inner pipe.

19. The valve of claim 17, wherein:

the bladder is connected to the outer pipe.

20. The valve of claim 17, wherein:

the inner pipe has a plug therein.

21. A system for controlling flow in a well, comprising:

at least one valve in the well, the at least one valve comprising an inflatable bladder provided between a pair of substantially concentrically-disposed pipes and the at least one valve being part of a plurality of valves controlling flow from a zone; and at least one control line in communication with an interior of the inflatable bladder.

22. The system of claim 21, wherein said at least one valve controls flow from a plurality of formations.

23. A system for controlling flow in a well, comprising:

at least one valve in the well, the at least one valve comprising an inflatable bladder provided between a pair of substantially concentrically-disposed pipes and the at least one valve controlling flow from a plurality of formations; and at least one control line in communication with an interior of the inflatable bladder.

24. The system of claim 23, wherein one of said at least one valve is associated with one of the plurality of formations.

25. A system usable in a subterranean well, comprising:

a valve located in the well to control flow of a fluid from a subterranean formation, the valve comprising an inflatable bladder provided between a pair of substantially concentrically-disposed pipes; and at least one control line in communication with an interior of the inflatable bladder.

26. The system of claim 25, wherein the bladder is connected to the inner pipe.

27. The system of claim 25, wherein the bladder is connected to the outer pipe.

28. The system of claim 25, wherein the inner pipe has a plug therein.

* * * * *